US005107550A

United States Patent [19]

Hawro

[11] Patent Number: 5,107,550

[45] Date of Patent: Apr. 28, 1992

[54] SEWER PIPE UNPLUGGING TOOL

[76] Inventor: Edward Hawro, 44 Bedford Ave., Buffalo, N.Y. 14216

[21] Appl. No.: 605,189

[22] Filed: Oct. 22, 1990

Related U.S. Application Data

[63] Continuation-in-part of Ser. No. 474,937, Feb. 5, 1990, abandoned.

[51] Int. Cl.[5] ..... E03D 11/00; B08B 9/02

[52] U.S. Cl. ..... 4/255; 15/104.33

[58] Field of Search ..... 4/255-257, 4/661; 15/104.33, 104.31

[56] References Cited

U.S. PATENT DOCUMENTS

| | | | |
|---|---|---|---|
| 1,261,444 | 4/1918 | Schied | 4/257 |
| 1,796,340 | 3/1931 | Nowakowski | 15/104.33 |
| 1,851,766 | 3/1932 | Hotchkiss, Jr. | 15/104.33 |
| 1,982,402 | 11/1934 | Shade | 15/104.33 |
| 2,042,407 | 5/1936 | Kugelman | 15/104.33 |
| 2,961,675 | 11/1960 | Stickney | 15/104.33 |
| 3,118,159 | 1/1964 | Kollmann | 15/104.33 |
| 3,121,244 | 2/1964 | Hunt | 15/104.33 |
| 4,364,140 | 12/1982 | Irwin | 15/104.33 |

*Primary Examiner*—Henry J. Recla
*Assistant Examiner*—Robert M. Fetsuga
*Attorney, Agent, or Firm*—Wallace F. Neyerlin

[57] ABSTRACT

A simple, inexpensive apparatus which enables an ordinary power snake to be rotated by an electric drill. The apparatus consists of a telescope connected to a series of flexible tubes, i.e. garden hoses joined together by suitable couplings and an optional adapter for attaching the series of flexible tubes to the drain line. An electric drill is attached to the end of the snake protruding from the telescope to rotate the snake encased by the telescope and the tube train. Collapsing the telescope forces the snake into the drain line. Removing the telescope and the first section of the tube train and then reconnecting the telescope to the shortened tube train enables more snake to be forced down the drain line. This process may, of course, be repeated, as found necessary or desirable for complete unplugging of the drain line.

4 Claims, 4 Drawing Sheets

Fig. 3
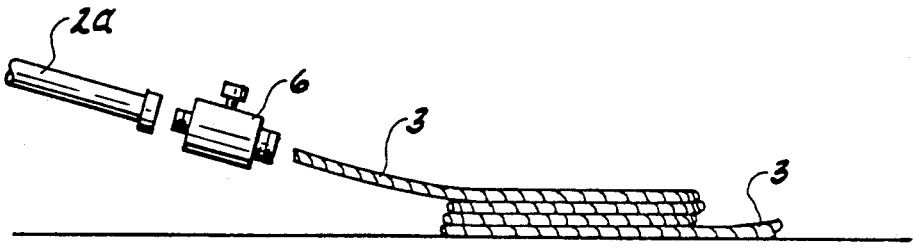
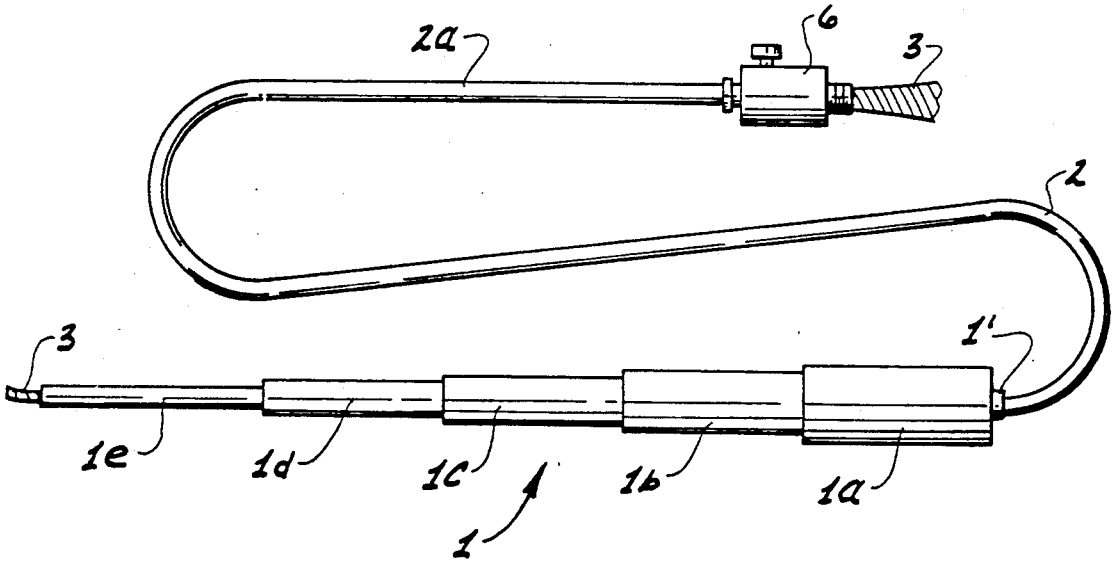
Fig. 4

SEWER PIPE UNPLUGGING TOOL

This application is a continuation-in-part of application Ser. No. 07/474,937, filed Feb. 5, 1990 now abandoned.

BACKGROUND OF THE INVENTION

1. Field of the Invention

This invention relates to devices which are used to insert a sewer snake into a drain line or sewer pipe for the purpose of removing obstructions in the line or pipe.

2. Description of the Related Art

In prior art, the sewer snake has been contained in a canister which is rotated (U.S. Pat. Nos. 2,042,407, 2,237,880, 3,897,602).

Telescopic devices have been used to advance the snake into the pipe (U.S. Pat. Nos. 2,042,407, 2,237,880, 3,897,602, 1,796,340, 4,364,140).

A canister arrangement is generally quite heavy and difficult to maneuver. Because of the moment of inertia of the rotating canister and the coil of snake inside, the device will continue to rotate even after power to the rotating motor is interrupted. This may damage the snake if it has become stuck in the pipe.

Lawrence F. Irwin suggested a telescopic device described in U.S. Pat. No. 4,364,140. This provides an efficient means for advancing a length of snake down a pipe. However, to advance long lengths of snake, the snake must be made of segments which are coupled together.

Disadvantages of this are:

1. The snake is much more expensive than an ordinary single piece sewer snake because of the coupling devices required.

2. The coupled segments of the snake decrease the flexibility of the snake making it more difficult to negotiate bends in the pipe.

3. The coupling segments may separate, leaving a length of snake in the pipe. Retrieval of the lost piece may be quite costly.

SUMMARY OF THE INVENTION

The drain cleaning apparatus of the present invention consists of a plurality, of telescoping tubes in which one end of a snake is contained, plus a plurality of flexible tubes surrounding the snake and through which the snake passes; and optionally an adapter which is attached to a drain. As the telescoping tubes are collapsed, the snake is advanced, as more fully described hereinafter with reference to the drawings. The snake is rotated by a drill motor which is attached to the snake at the outer end of the telescoping tubes. After a predetermined length of snake has been advanced into the drain by collapsing the telescoping tubes, the latter can be disconnected from the first flexible tube which can be removed, and thereafter the telescoping tubes can be expanded and connected to the remaining flexible tubes so as to repeat the snake advancing process by collapsing the telescoping tubes.

This invention enables the use of a continuous non-segmented snake while maintaining the simplicity of a telescope for advancing the snake.

It is superior to the canister devices along the torque is always applied along the axis of an uncoiled snake (even though the assembly of tubes with the snake coaxially contained may have to negotiate curves to accomodate physical restrictions in the building containing the waste pipe to be cleaned;) and the flywheel effect of the canister and the coiled snake is eliminated.

Use of this device is also quite clean since the operator need not handle the snake but works at the end of the snake opposite that which goes down the drain. Also, the surroundings are protected from water splash from a rotating snake since the snake is continually enclosed either by the series of tubes or by the telescope.

In some instances, e.g. drains for roof downspouts, it will be possible to insert the flexible tubes with the contained snake some distance down the pipe. This will lessen the tendency of the snake to wind itself up in large diameter pipes.

In sum, this invention provides a clean, efficient, and inexpensive means of advancing a sewer snake down a pipe. It accomplishes this with a novel combination of a series of connected flexible tubes, a telescope which can be coupled with these tubes, and an optional adapter of novel construction which may be used to secure the device to a drain line and permit easier and more efficient operation by one operator. In its simplest form, a single flexible tube may be used where sufficient lengths of snake to reach the blockage in the waste pipe may be inserted by one collapse of the telescope.

The operator of the device holds the drill in one hand after its chuck has been clamped around snake 3 and generally grasps the second smallest diameter telescoping tube (tube 1*d* of FIG. 4), (or the tube next to the tube to be contacted by the drill) turns on the drill, and pushed on the drill while simultaneously pushing telescoping tube 1*e* into telescoping tube 1*d;* and then sequentially repeats this procedure by grasping the circumference of tube 1*c* and pushing it into tube 1*b*, etc.

Figure 2:
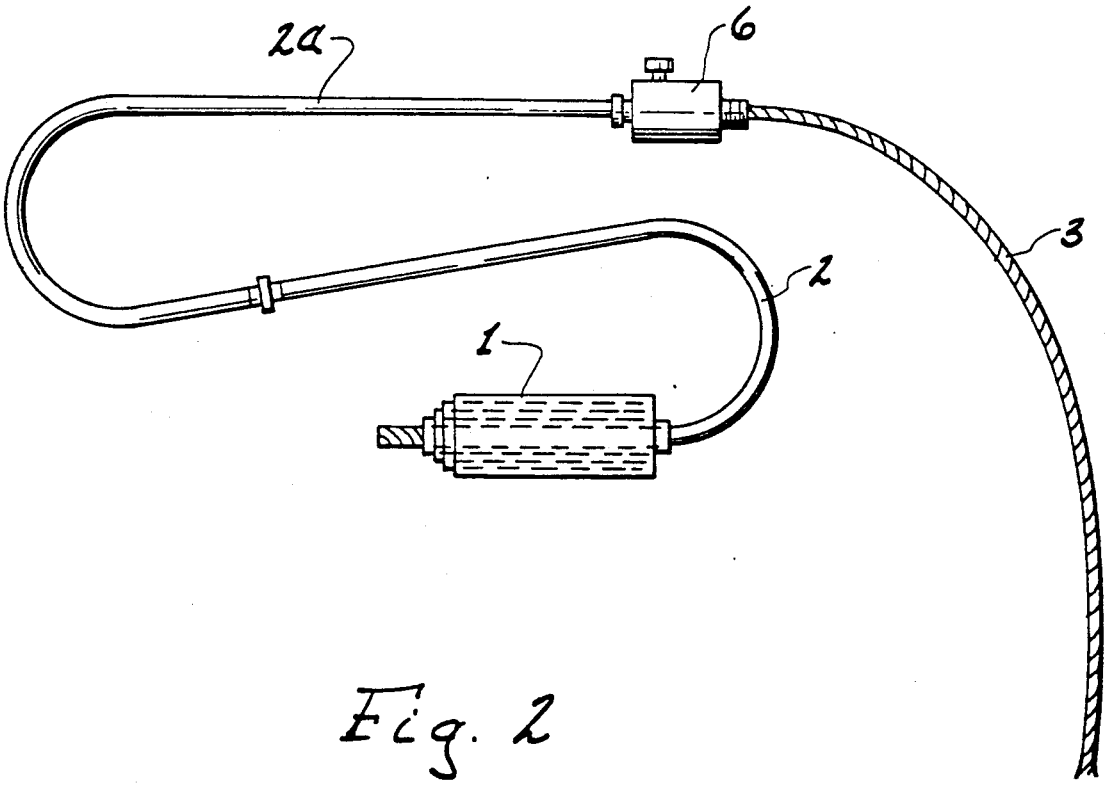

FIG. 2 is a perspective view showing the telescope attached to the tube train, which in turn is attached to the adapter. The snake is shown coming through the adapter, ready for insertion into the drain line, after which the adapter will be threaded into the drain line. The opposite end of the snake is fed through the adapter, through the tube train and through the telescope, which is shown in its fully collapsed condition.

FIG. 3 is a perspective view (partially broken) showing a snake as it is about to be fed through the adapter and then through the tube train, prior to being fed through the telescope; the length and thickness or diameter of the snake to be decided upon beforehand, as discussed more fully hereinafter FIG. 4 is a perspective view similar to FIG. 2, but also showing the telescope with its various sections extended in length and the snake protruding from the end of the telescope distant from its opposite end which is connected to the tube train. This protruding end of the snake is thus in its desired and intended position to be clamped in the jaws of an electric drill in order to provide power to rotate the snake its entire length.

Figure 1:
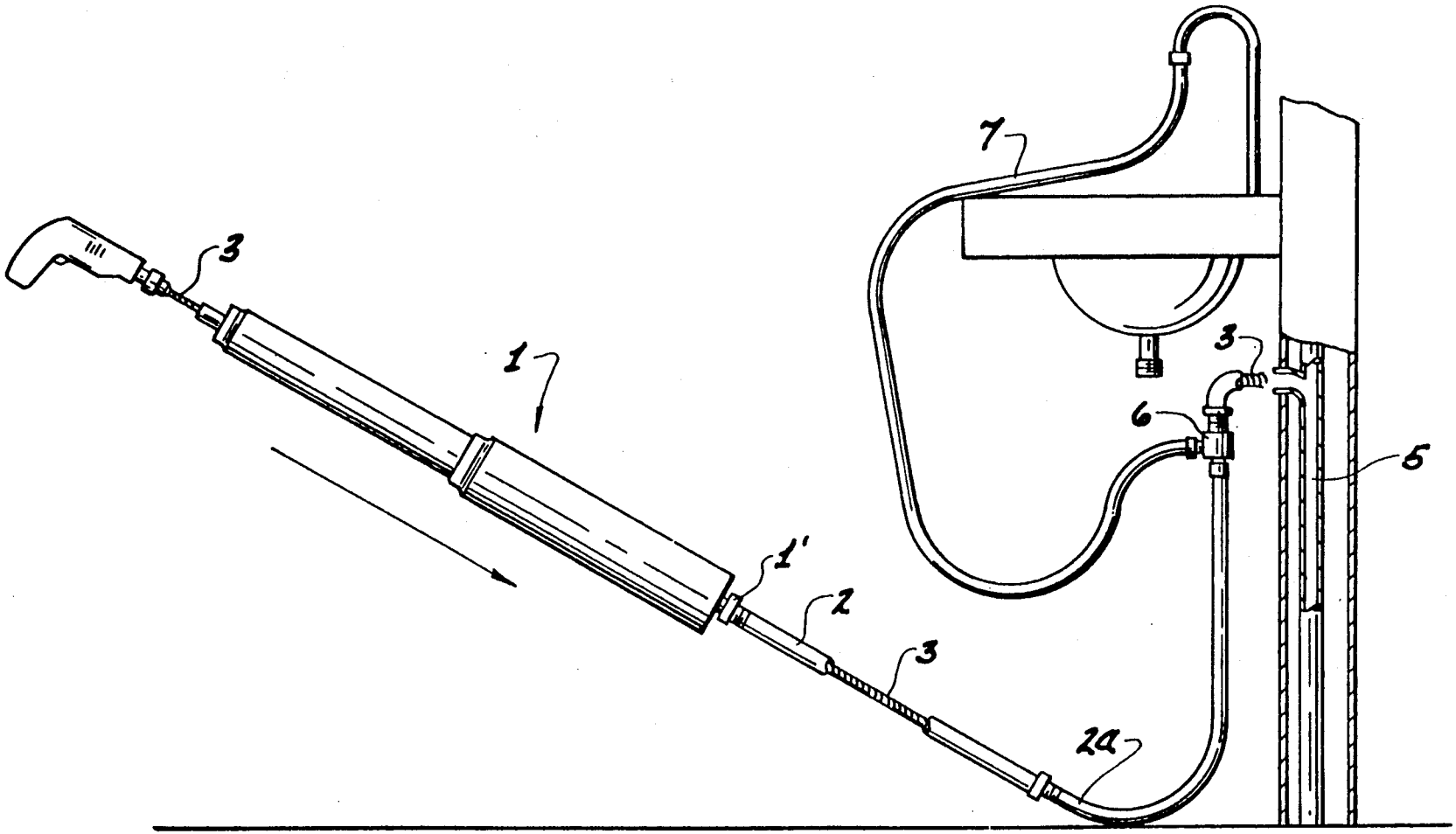
FIG. 1 is an overall view (partially broken for illustrative purposes) of the device in operation. The tube train is attached to the drain line with the optional adapter to which a water supply has been connected. In this view the cleanout operation has been underway and the telescope is partially collapsed.
Figure 5:
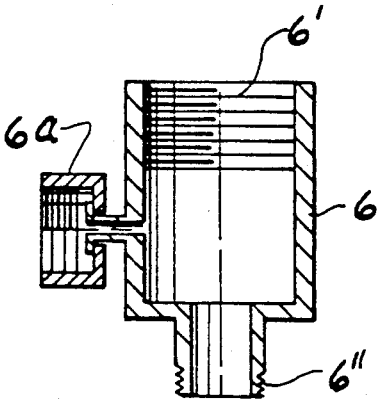

FIG. 5 is a cross-sectional end view of the adapter for coupling the tube train to the drain line and also for attaching a cleaning and pressure hose to the adapter from a water supply as illustrated in FIG. 1.

Figure 5A:
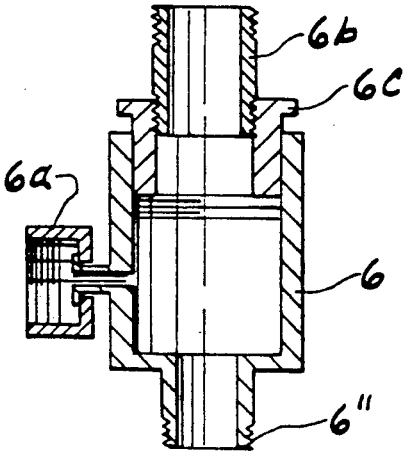

FIG. 5a is a cross-sectional end view of the adapter of FIG. 5 but also including a bushing in same in order to enable the adapter to be coupled to a "female" threaded drain line, as compared to the adapter without the bushing which is adapted to be coupled to a "male" threaded drain line.

Figure 6:
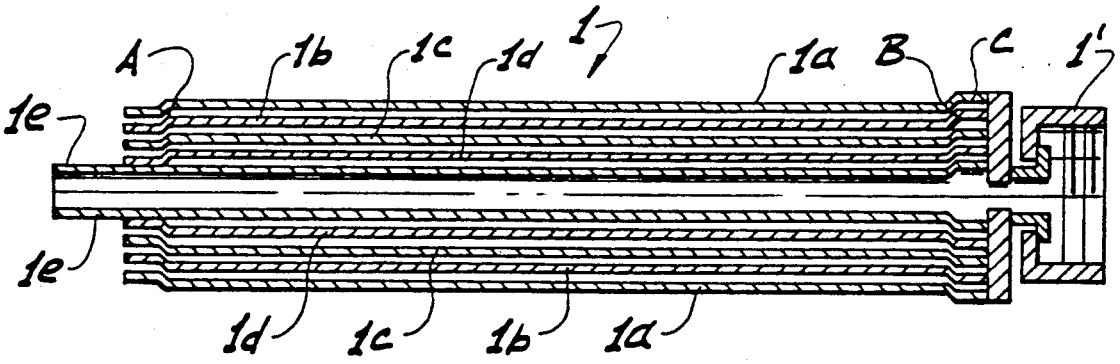

FIG. 6 is a cross-sectional view of one type of telescope useful in carrying out the invention, said telescope having 5 collapsible and/or extendable sections in same, the length of each section typically being about 1½ to 2 feet long.

DESCRIPTION OF PREFERRED EMBODIMENTS OF THE INVENTION

Referring now to FIG. 1 in more detail, there is shown the series of tubes or hoses 2 and 2a which surround the snakes and each segment of which or all of which can be removed as the snake is worked down the drain pipe 5. The telescope 1 has a fitting 1' at one end to permit attachment of the series of flexible tubes 2 and 2a. (It should be noted that typically more than two such sections of tubes or hoses may be employed.) The telescope 1 consists of a series of tubes (typically 4 or 5, as shown in FIG. 4) which slide easily into one another and which have ends slidably formed (shown in FIG. 6) to prevent the tubes from coming apart when the telescope is extended, as illustrated in FIG. 4.

A very suitable telescope was constructed from 5 sections of polyvinyl chloride tubing (PVC) each of different internal and external diameter by simply warming the ends of each of the tube sections in glycerol at about 250 degrees Fahrenheit and forcing it into a form of either constrict the end or expand the end as needed. If preferred, a non-corrosive metal telescope can also be used.

Referring now to FIGS. 5 and 5a, the adapter 6, used to connect the train of flexible tubes which surround the snake to the drain line 5, has at one end female pipe threads opening 6' typically 1½ inch in diameter. At the opposite end, is a male garden hose thread 6" of smaller diameter for connecting the garden hose section 2a containing the snake 3 to the drain line via the adapter. At the center of the adapter is a female garden hose swivel 6a for attachment to a water supply depicted generally as 7 in FIG. 1 such as from a sink or from a laundry tub, etc.

By use of the proper nipples and/or bushings, the adapter 6 can be attached to male and female pipes of various sizes.

Connecting a water supply 7 to the adapter 6 has three main advantages:

1. Introducing water lubricates the snake so that it turns more easily.

2. Once the snake has broken through, the water will flush debris loosened by the snake down the pipe.

3. As the snake is withdrawn, the water will wash grime from the snake, making the operation much cleaner than other competitive ways for cleaning out and/or unblocking drain lines.

Referring now to FIG. 4, this Figure shows the telescope in its extended condition, and made up of 5 segments, 1a, 1b, 1c, 1d and 1e, with fitting 1' at the end of segment 1a for attachment to flexible hose 2. (It should be noted, of course that a suitable bushing may be connected between segment 1a of the telescope and section 2 of the flexible hose in order to accommodate connections to either the male end of the hose or the female end of the hose).

Referring now to FIG. 6:

This is a cross section view of a typical telescope useful in the present invention. One end of each tube of the telescope is constricted as at area A while the end of the next smaller tube is expanded as at area B so that the tubes will not slide apart when the telescope is extended. The large end C of the telescope has fitting 1' for connection to the train of flexible tubes.

The length of the telescope extended minus the length collapsed in referred to as the collapse length of the telescope. This is equal to the maximum length of snake that can be advanced into the pipe with one collapse of the telescope. This length then is also the maximum length of each train of flexible tubes. The length of the sections of the tube train may be less than this. This means that the telescope need not be fully extended after each tube section is removed. This may be advantageous where space is so constricted that full extension of the telescope is difficult or impossible. However, the greater number of short sections of hose used will increase costs because of the extra couplings required, and so this alternative arrangement will typically be avoided, if possible.

The flexible tubes containing the snake are attached to each other by removable couplings. An ordinary garden hose coupling is an example of such a coupling.

The number of sections in the telescope is arbitrary. More sections allow for a greater collapse length but also increase the cost of the telescope. Four, five or six sections will be typical.

The length of each tube of the telescope is also variable. For most users of the device a length of 12 to 24 inches is about right.

Having thus described the invention, it should be apparent that numerous modifications and adaptations may be resorted to without departing from the scope and fair meaning of the instant application as described here and above and as claimed here and below.

I claim:

1. A waste pipe cleanout apparatus consisting essentially of:

a. a plurality of telescoping tubes, said plurality of telescoping tubes having a lead tube of relatively small diameter and an end tube of larger diameter with means for releasable attachment to at least one flexible hose;

b. a flexible hose connected at one end to the releasable attachment means of the tube of larger diameter of the telescoping tubes;

c. an adapter releasably connected to the other end of the flexible hose, said adapter being suitable for connection to the waste pipe which is to be cleaned out; and d. a continuous, non-segmented snake slidably contained co-axially within the plurality of telescoping tubes, the flexible hose, and the adapter, one end of which snake is to operate to bore out the blockage in the waste pipe and which extends from the adapter, and the other end of which snake extends out from the end of the relatively smaller diameter lead telescoping tube most distant from the flexible hose and is capable of being connected to an electric drill so as to rotate the snake within the plurality of telescoping tubes, within the flexible hose, within the adapter and within the waste pipe which is to be cleaned out.

2. A waste pipe cleanout apparatus according to claim 1 wherein the adapter also has means for being connected to a water supply so as to accommodate a supply of water to the waste pipe which is to be cleaned out as the snake is being rotated in the waste pipe by means of the electric drill.

3. A waste pipe cleanout apparatus consisting essentially of:

a. a plurality of telescoping tubes, said plurality of telescoping tubes having a lead tube of relatively small diameter and an end tube of larger diameter with means for releasable attachment to a train of flexible hoses;

b. a train of flexible hoses connected at one end to the releasable attachment means of the tube of larger diameter of the telescoping tubes, with means permitting easy joining and unjoining of the segments of the train from each other and also from the telescoping tube of larger diameter to which the train is connected;

c. an adapter releasably connected to the other end of the train of flexible hoses, said adapter being suitable for connection to the waste pipe which is to be cleaned out; and d. a continuous, non-segmented snake slidably contained co-axially within the plurality of telescoping tubes, the train of flexible hoses, and the adapter, one end of which snake is to operate to bore out the blockage in the waste pipe and which extends from the adapter, and the other end of which snake extends out from the end of the relatively small diameter lead telescoping tube most distant from the end connected to the flexible hose train and is capable of being connected to an electric drill so as to rotate the snake within the plurality of the telescoping tubes, within the flexible hose train, within the adapter and within the waste pipe which is to be cleaned out.

4. A waste pipe cleanout apparatus according to claim 3 wherein the adapter also has means for being connected to a water supply so as to accommodate a supply of water to the waste pipe which is to be cleaned out as the snake is being rotated in the waste pipe by means of the electric drill.

* * * * *